US005162804A

United States Patent [19]

Uyeda

[11] Patent Number: 5,162,804

[45] Date of Patent: Nov. 10, 1992

[54] AMPLITUDE DISTRIBUTED SCANNING SWITCH SYSTEM

[75] Inventor: Harold A. Uyeda, Fullerton, Calif.

[73] Assignee: Hughes Aircraft Company, Los Angeles, Calif.

[21] Appl. No.: 701,941

[22] Filed: May 17, 1991

[51] Int. Cl.[5] ..... H01Q 3/22; H01Q 3/24; H01Q 3/26

[52] U.S. Cl. ..... 342/373; 342/372

[58] Field of Search ..... 342/373, 368, 371, 372

[56] References Cited

U.S. PATENT DOCUMENTS 4,122,453 10/1978 Profera .
4,425,567 1/1984 Tresselt .

*Primary Examiner*—Theodore M. Blum
*Attorney, Agent, or Firm*—W. K. Denson-Low

[57] ABSTRACT

An amplitude distributed scanning switch system including a multiple of eight inputs and outputs, the former including m=0 and m=±1 mode terminals coupled to a 1:3 power divider and phase shifter network for producing a tapered amplitude distribution at the outputs which can be scanned by varying the m=±1 mode phases.

4 Claims, 7 Drawing Sheets

AMPLITUDE DISTRIBUTED SCANNING SWITCH SYSTEM

BACKGROUND

The present invention relates generally to feed systems for beam scanning and dual mode circular antenna arrays, and more particularly to a power distribution scanning switch feed for such arrays.

Prior art techniques for feeding beam scanning and dual mode circular antenna arrays are relatively complex, difficult to fabricate and adjust, and costly. These techniques include the use of two Butler matrices, and the use of one such matrix fed by a one-to-eight (1:8) power divider and eight separate phase shifters.

Also, in NRL (National Research Laboratories) Report number 6696, a disclosure was made by E. Sheleg which employs a Butler matrix fed by a 1:n power divider, and the Stanford Research Institute also investigated a bi-conical horn which forms a rotatable cardioid pattern. However, the latter was restricted to a four-element Butler matrix.

Although there has been other discussions in the literature regarding the need for simplification of such circular antenna array feeding schemes, no actual implementation has been described to date in technical reports.

In contrast thereto, the disclosed invention employs a relatively simple and less complex scheme to provide the required feed for such circular antenna array. The invention utilizes an eight element Butler matrix or an equivalent matrix which produces equal amplitude outputs (coupled to the circular array) with varying progressive phase modes when any of its eight inputs is excited.

The $m=0$ and $m=\pm 1$ mode inputs to this matrix are coupled to a one-to-three (1:3) power distribution and phase variable network. The matrix and power distribution/phase variable network make up a composite switch which produces a symmetrical power distribution centered about the peak and decreasing to a minimum on either side of the peak, and its max/min amplitude ratio can be optimized by varying the 1:3 power divider outputs coupled to the matrix. This is made possible by the use of a conventional 1:3 power divider coupled to the aforementioned $m=0$ mode and two conventional phase shifters which feed the $m=\pm 1$ mode inputs to the matrix. The power distribution of the matrix outputs including the max/min positions can be scanned across the outputs by selectively setting appropriate phase states of the phase shifters at the $m=\pm 1$ inputs of the matrix.

Thus, it can be seen that this new technique simplifies the network configuration because the 1:8 power divider or matrix is replaced by a 1:3 power divider. This has obvious cost and other advantages, and also has improved electrical performance because the ohmic interconnection line losses will be lower with this new design. Further, with the simpler design of the present invention, the amplitude taper of a circular array can be optimized to effectively miximize radiation from the peak directed elements and minimize the radiation from the rear directed elements in order to suppress the backlobe intensity.

SUMMARY OF THE INVENTION

As noted previously, the power distribution scanning switch of this invention is used with beam scanning circular arrays and dual mode (omnidirectional and sector scanned beams) circular arrays. The invention can be hard connected to the antenna array, and eliminates switches at the radiating element level so as to transfer and maximize the power distribution and taper in the direction of the desired beam scan.

The power distribution scanning switch of the invention provides the capability to transfer the distribution to any array sector by controlling the excitation phases of the $m=\pm 1$ phase mode inputs to the Butler matrix. The power taper can also be optimized to minimize radiation from rear directed radiation elements. And, although the description of the invention herein mainly stresses an eight-element design, it can be extended to 16-, 32-, etc., element configurations.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
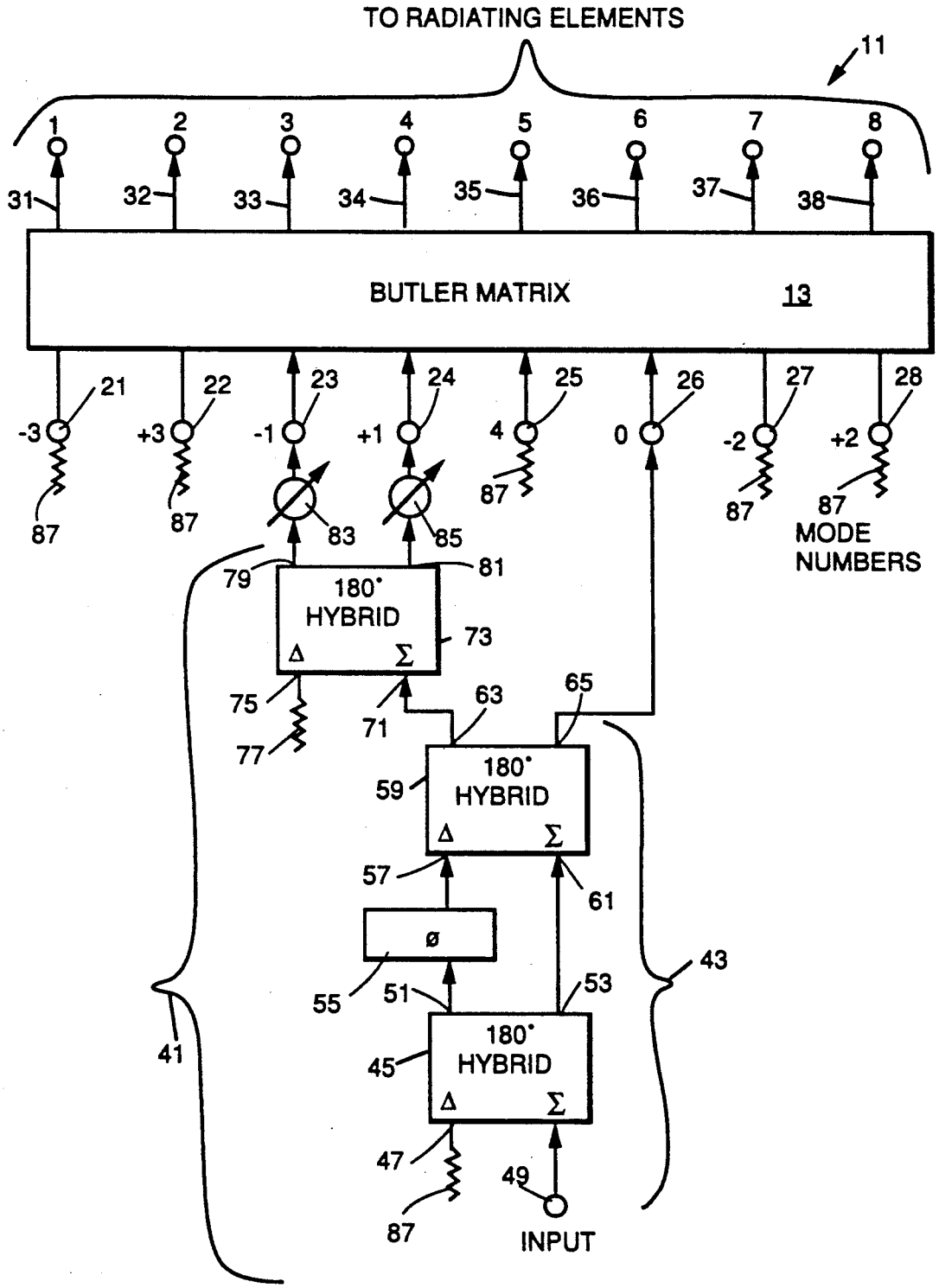
FIG. 1 schematically represents the amplitude distributed scanning switch in accordance with the present invention.
Figure 2:
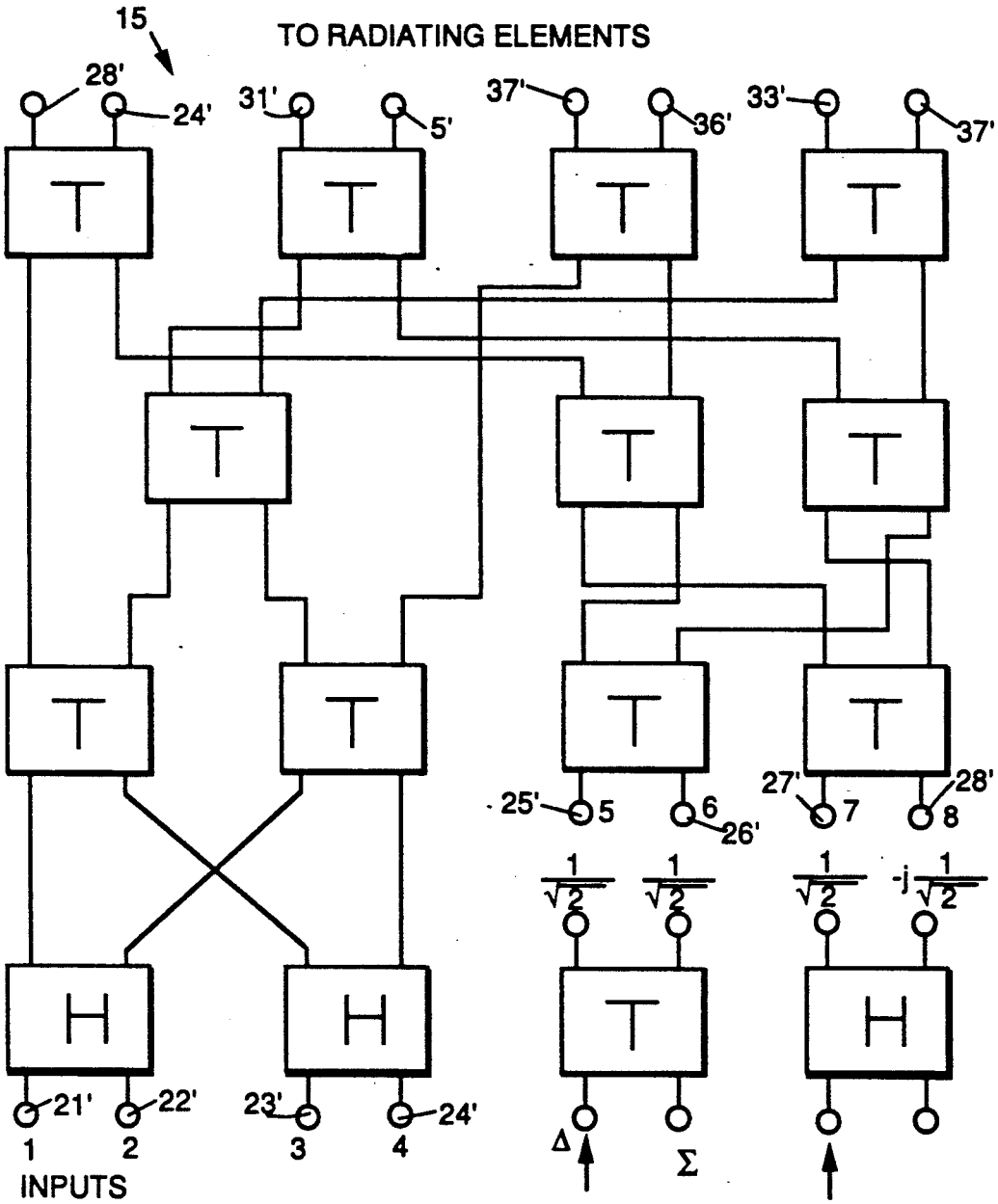
FIG. 2 is a schematic diagram of an eight-element matrix useable in the amplitude distributed scanning switch of FIG. 1.

Referring now to the drawings, and more particularly to FIGS. 1 and 2, an embodiment 11 of the present amplitude distributed scanning switch invention is shown schematically to include a conventional eight-element Butler matrix 13 or equivalent eight-element matrix 15 (FIG. 2) having eight input terminals 21–28 and eight output terminals 31–38. The mode numbers assigned to each of the input terminals are herein identified as 21$=-3$, 22$=+3$, 23$=-1$, 24$=+1$, 25$=\pm 4$, 26$=0$, 27$=-2$, and 28$=+2$. Coupled to terminals 23, 24, and 26 of the matrix 13 is a 1:3 power divider and phase shifter network 41 that includes an unequal 1:2 power divider section 43.

The unequal power divider section 43 includes a conventional 180° hybrid 45 having a first input terminal 47 and a second input terminal 49, a first output terminal 51, and a second output terminal 53. The first output terminal 51 is coupled through a conventional fixed phase shifter 55 to a first input terminal 57 of a second conventional 180° hybrid 59, while the hybrid's second input terminal 61 is coupled to the second output terminal 53 of the first hybrid 45. The output of the unequal power divider 43 consists of a first output terminal 63 of the second hybrid 59, and a second output terminal 65 of the same hybrid.

The first output terminal 63 of the 1:2 unequal power divider is coupled to a sigma (Σ) input terminal 71 of a third conventional 180° hybrid 73, while its delta (Δ) input terminal 75 is coupled to an appropriate conventional load 77. The second output terminal 65 of the power divider 43 is coupled to the mode=0 input terminal 26 of the matrix 13, and the first and second output terminals 79 and 81 of the hybrid 73 are coupled to the mode=−1 input matrix terminal 23 and mode=+1 matrix input terminal 24 through respective conventional first and second variable phase shifters 83 and 85. As is well known in the art, appropriate load impedances 87 are connected to all terminals that are not coupled to signal or voltage sources.

Thus, the basic elements of the amplitude distributed scanning switch 11 in accordance with this embodiment of the invention consist of the Butler matrix 13 or an equivalent such as the eight-element matrix 15 shown in FIG. 2, and a 1:3 power divider and the phase shifter network 41. The requirements of the matrix 13 are that it must provide equal amplitudes at the output terminals 31–38 when any of the input terminals 21–28 are excited. It must also have varying progressive phase shifts, including a constant phase m=0 mode at the outputs 31–38 depending on the input terminal excited. Table I below shows the output phases as a function of input terminal excitation for the matrix 15 described in FIG. 2, for example.

TABLE I

| Matrix Input | MATRIX OUTPUT PHASE 1 | 2 | 3 | 4 | 5 | 6 | 7 | 8 | Mode No. |
|---|---|---|---|---|---|---|---|---|---|
| 1 | 225 | 90 | 315 | 180 | 45 | 270 | 135 | 0 | M = −3 (Δ = −135°) |
| 2 | 45 | 180 | 315 | 90 | 225 | 0 | 135 | 270 | M = +3 (Δ = +135°) |
| 3 | 315 | 270 | 225 | 180 | 135 | 90 | 45 | 0 | M = −1 (Δ = −45°) |
| 4 | 315 | 0 | 45 | 90 | 135 | 180 | 225 | 270 | M = +1 (Δ = +45°) |
| 5 | 180 | 0 | 180 | 0 | 180 | 0 | 180 | 0 | M = ±4 (Δ = 180°) |
| 6 | 0 | 0 | 0 | 0 | 0 | 0 | 0 | 0 | M = 0 (Δ = 0°) |
| 7 | 270 | 180 | 90 | 0 | 270 | 180 | 90 | 0 | M = −2 (Δ = −90°) |
| 8 | 0 | 90 | 180 | 270 | 0 | 90 | 180 | 270 | M = +2 (Δ = +90°) |

Stated now more generally, the 1:3 power divider network 41, which feeds the matrix 13, consists of the variable phase shifters 83 and 85 fed by the 180° hybrid 73 which is, in turn, fed by the unequal 1:2 power divider 43. The fixed phase shifter 55 of the unequal power divider 43 is selected to achieve a 1:3 power distribution which maximizes the maximum-to-minimum amplitude ratio that the matrix 13 outputs. The outputs 79 and 81 of the 180° hybrid 73 are, respectively, connected to the mode input terminal 23, the m=−1 (−45° progressive phase shift), and the mode input terminal 24, the m=+1 (+45° progressive phase shift) of the matrix 13. The third output of the 1:3 power divider 43, which has the higher amplitude, is connected to the input terminal 26, the m=0 mode, of the matrix 13.

For a prescribed setting of the variable phase shifters 83 and 85, at the m=±1 mode terminals (23 and 24), the outputs 31–38 of the matrix 13 will provide a tapered amplitude distribution with the maximum-to-minimum amplitude ratio determined by the excitation amplitude levels at the matrix input terminals 21–28. This distribution can be repositioned or scanned by resetting of the m=±1 variable phase shifters 83 and 85 to another prescribed set of phases.

Table II below lists the variable phase shifter values required to position the maximum at any one of the eight matrix outputs. Also listed are the phase values which will maximize the amplitudes at pairs of adjacent outputs. The phase shifters 83 and 85 are four bit devices which is required to have a minimum bit size of 22.5°.

TABLE II

| Amplitude maximum (Output port) | Phase of Input 23 (m = −1 mode) | Phase of Input 24 (m = +1 mode) |
|---|---|---|
| 31 | 45° | 45° |
| 31–32 | 67.5° | 22.5° |
| 32 | 90° | 0° |
| 32–33 | 112.5° | 337.5° |
| 33 | 135° | 315° |
| 33–34 | 157.5° | 292.5° |
| 34 | 180° | 270° |
| 34–35 | 202.5° | 247.5° |
| 35 | 225° | 225° |
| 35–36 | 247.5° | 202.5° |
| 36 | 270° | 180° |
| 36–37 | 292.5° | 157.5° |
| 37 | 315° | 135° |
| 37–38 | 337.5° | 112.5° |
| 38 | 0° | 90° |
| 38–31 | 22.5° | 67.5° |

Figure 3:
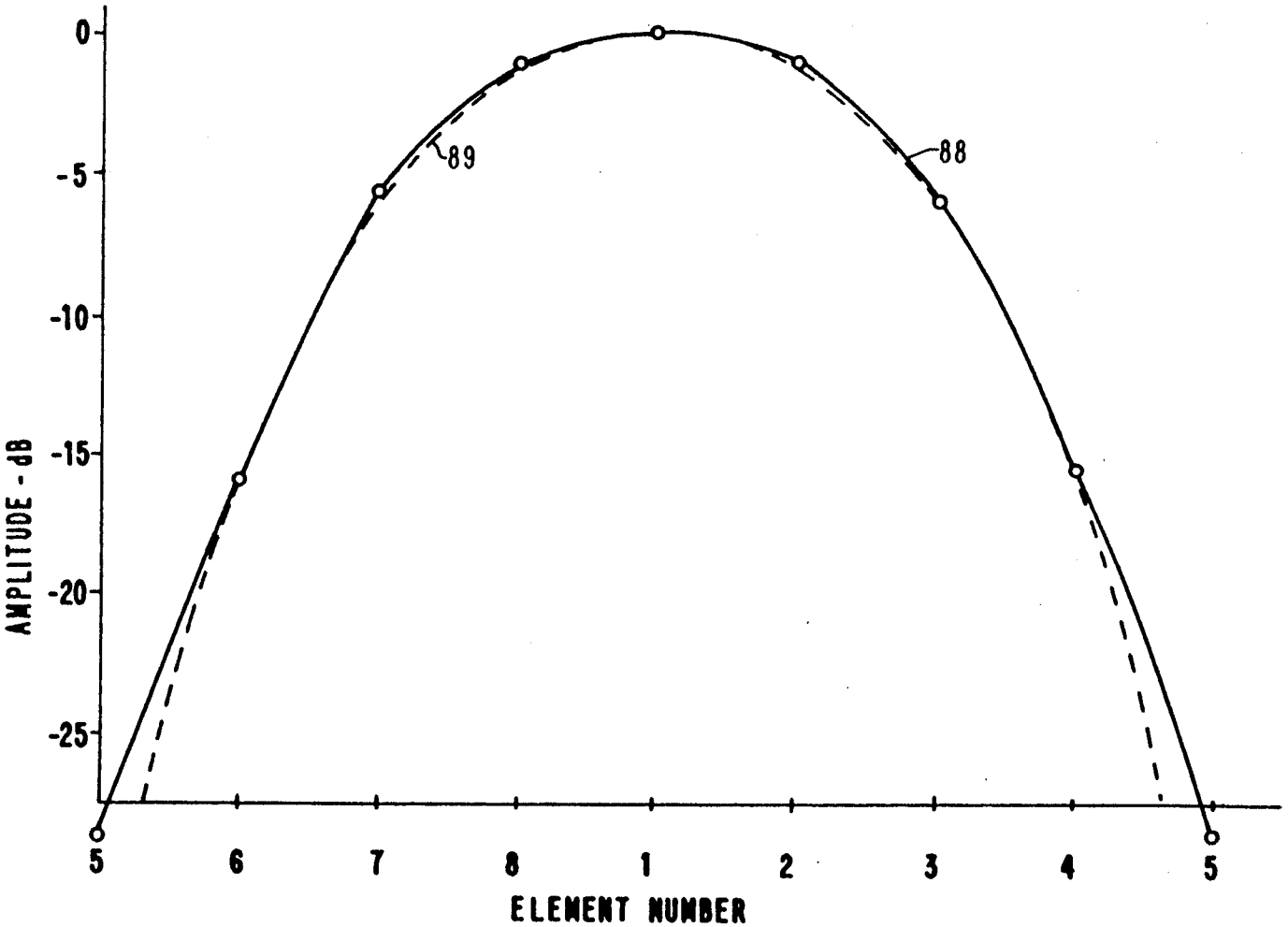
FIG. 3 is a graph showing the amplitude levels at the matrix outputs for the maximum scanned to the first matrix output terminal.
Figure 4:
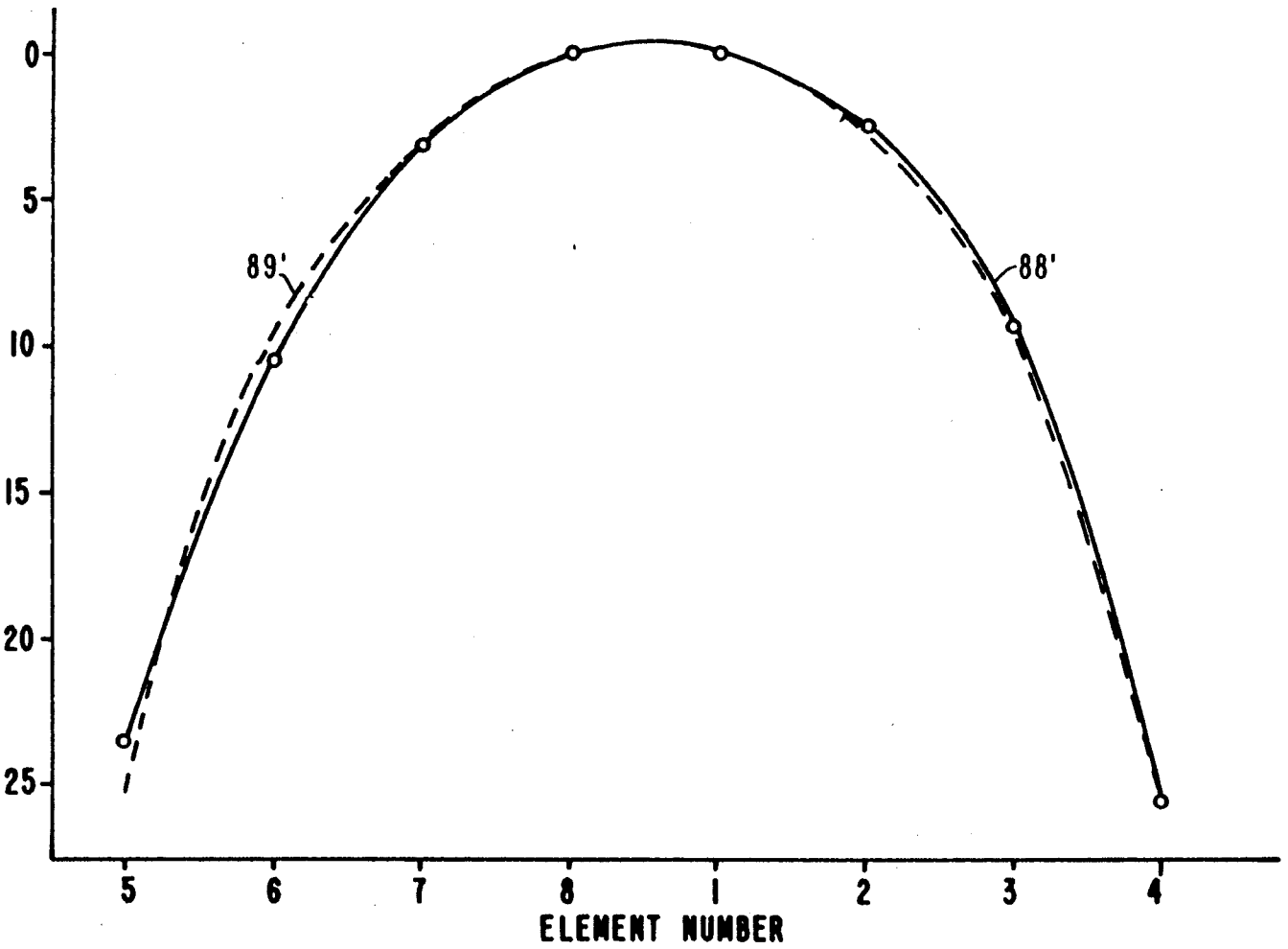
FIG. 4 is a graph showing the amplitude levels at the matrix outputs for the maximum scanned shared by the matrix first and third outputs.

Examples of amplitude levels at the matrix outputs 31–38 for an amplitude distributed scanning switch constructed in accordance with the present invention are shown in the graph of FIG. 3 for the maximum scanned to the first output terminal 31, and in FIG. 4 for the maximum shared by the first and eighth output terminals 31 and 38. The measured (solid line 88 in FIG. 3, and solid line 88' in FIG. 4) and calculated (dashed line 89 in FIG. 3, and dashed line 89' in FIG. 4) amplitudes based on ideal voltages at m=±1 (matrix inputs 23 and 24) and m=0 (matrix input 26) input terminals of the matrix 13 are denoted in these graphs. These voltage levels are obtained by selecting the fixed phase shift value (phase shifter 55) of the 1:3 power divider 43.

Figure 5:
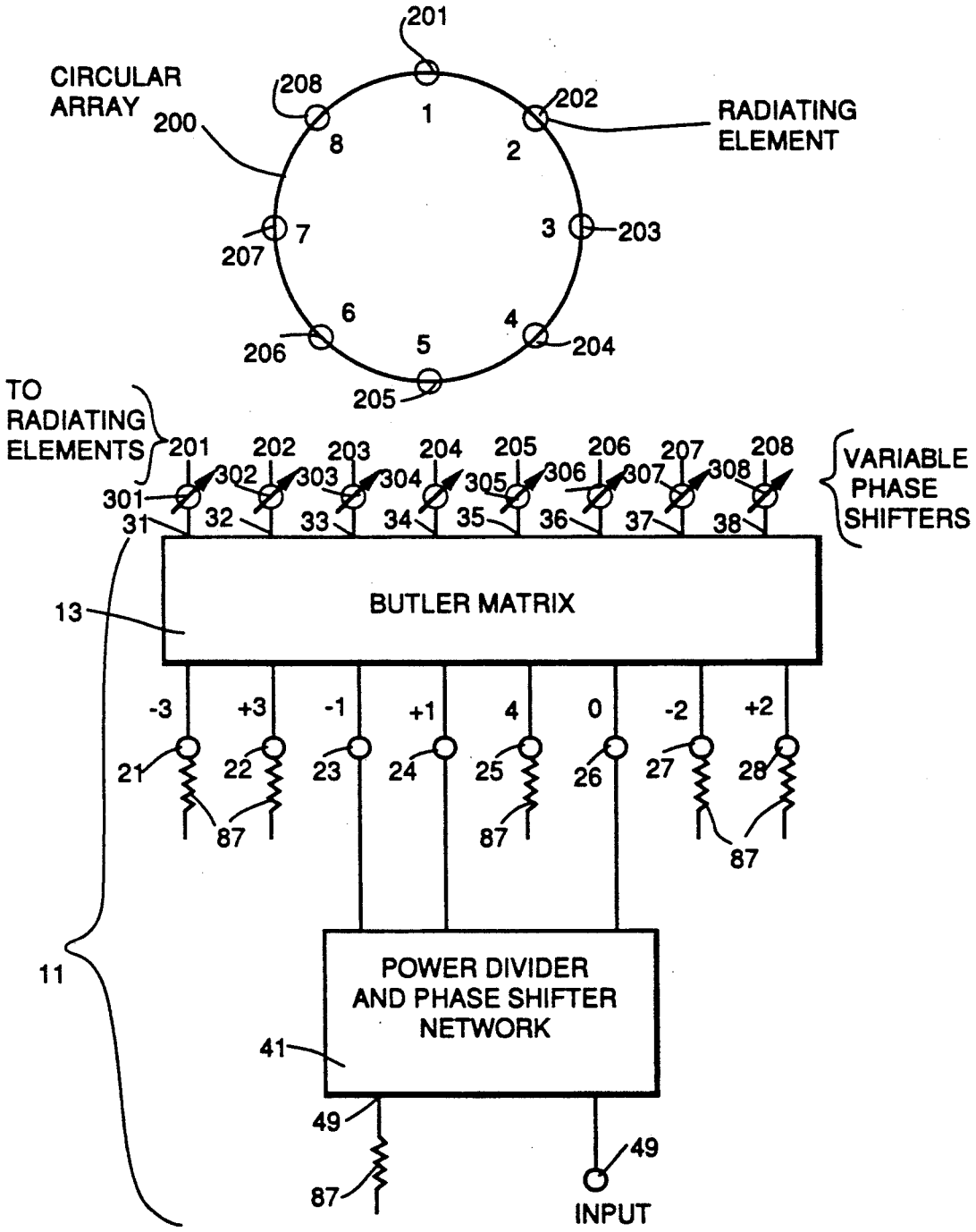
FIG. 5 is a schematic illustration showing the use of the amplitude distributed scanning switch of the invention and a scanning circular array.

The amplitude distributed scanning switch 11 can be applied to a scanning circular array such as circular array 200, as shown in FIG. 5. The array 200 includes input ports 201–208, and switch 11 is employed to scan the distribution so that the matrix element with the maximum amplitude is co-aligned with the direction of the main radiated beam. The switch 11 also reduces the amplitude levels in the rear to minimize the radiated back lobes. As the main beam is scanned through 360, the switch will reposition the distribution to co-align the peak element amplitude with the scan position of the antenna beam. To implement the beam scan, conventional variable phase shifters 301–308 are coupled between the matrix output terminals 31–38 and the radiating elements 201–208 in order to achieve beam collimation.

Figure 6:
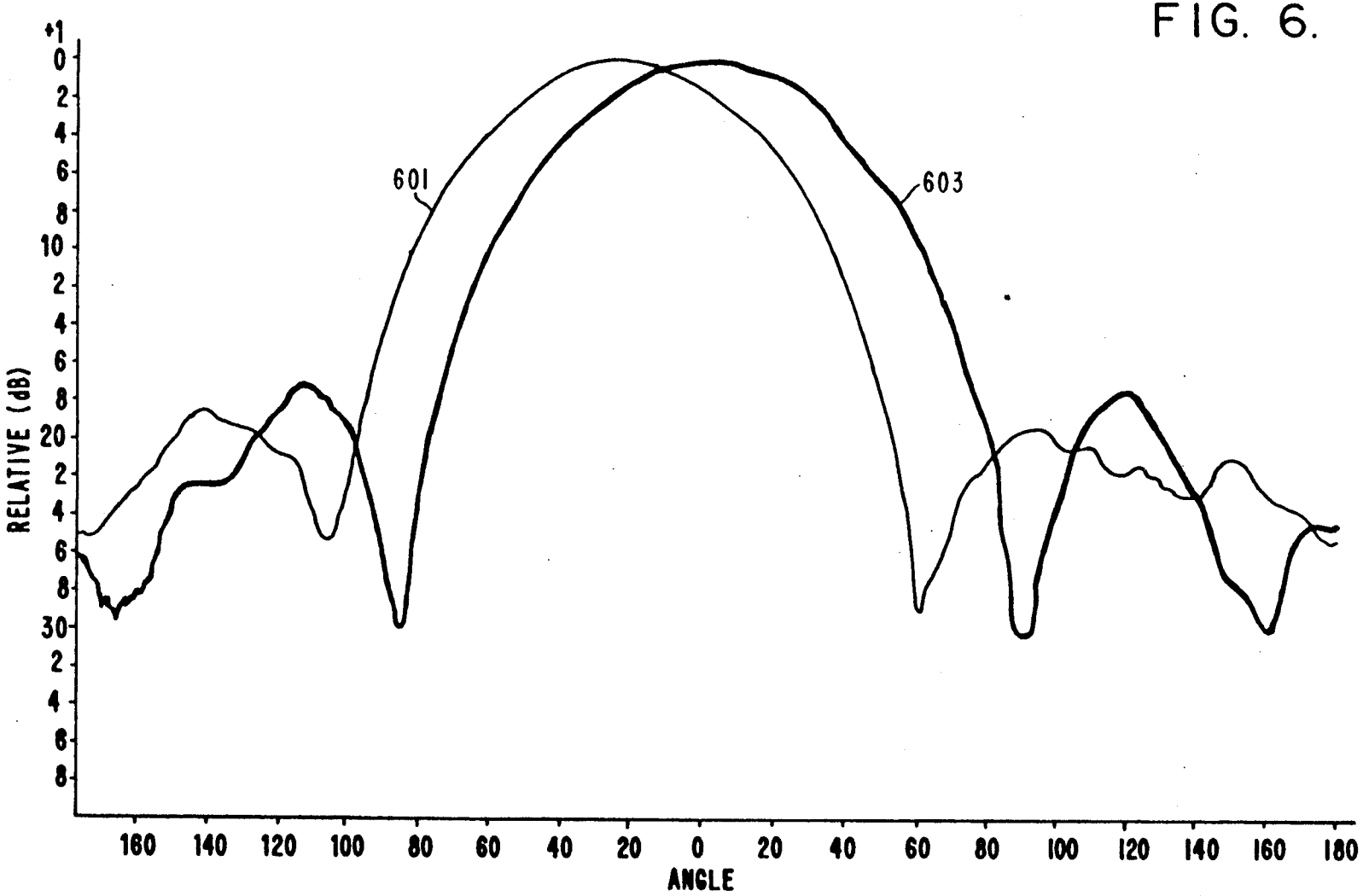
FIG. 6 is a graph showing the corresponding radiation patterns of the circular array with the distribution peak amplitude co-aligned with the direction of beam scan.

The corresponding radiation patterns of the circular array 200 with the distribution peak amplitude co-aligned with the direction of beam scan is shown in FIG. 6. Curve 601 illustrates a pattern where the matrix output maximums are scanned to the second and third elements, while curve 603 shows a pattern where the matrix output maximum is scanned to the first element.

Figure 7:
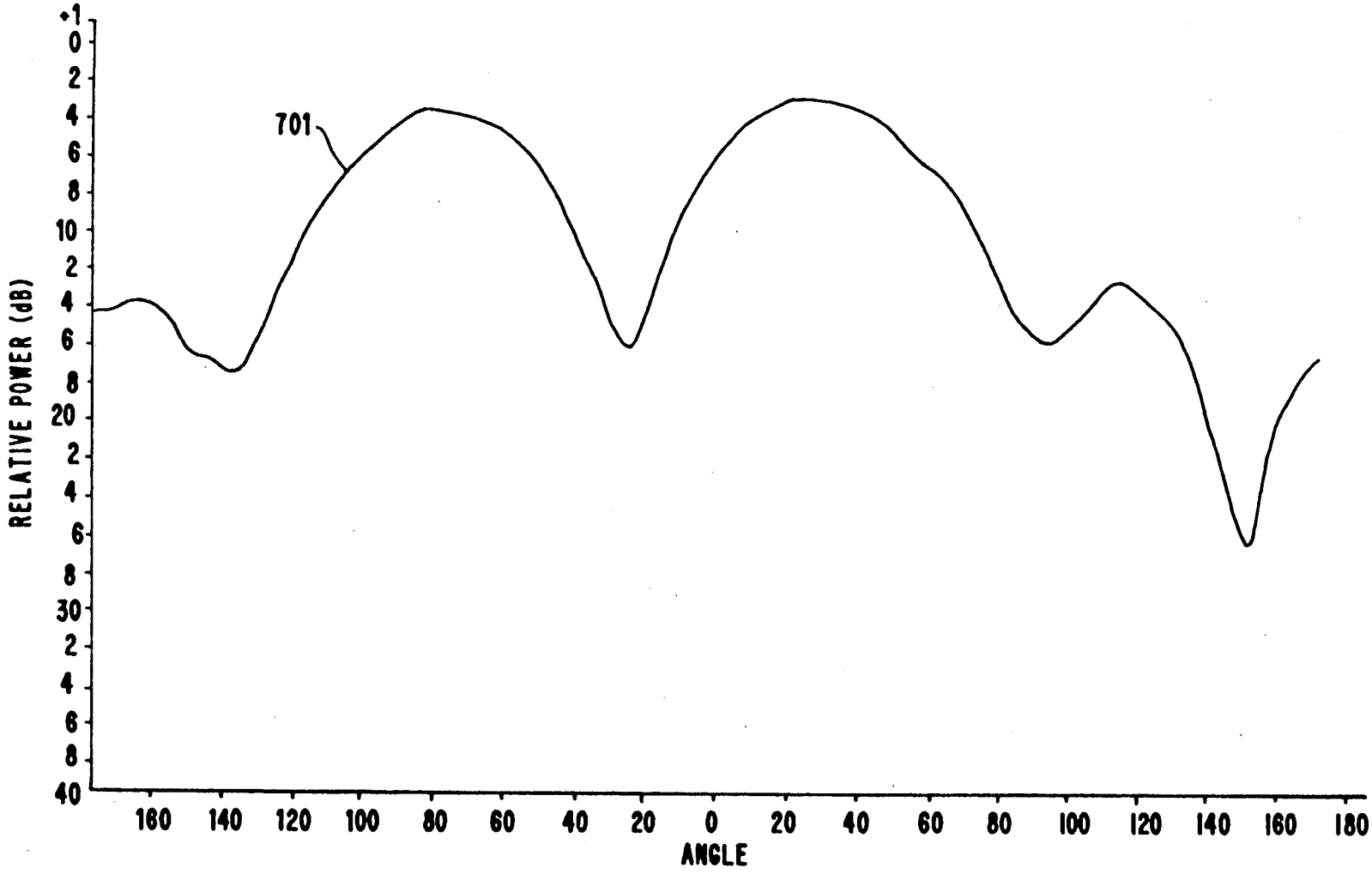
FIG. 7 is a graph of a difference beam generated by setting one-half of the element phase shifter of the invention one hundred eighty degrees out of phase relative to the other half of the phase shifter.

A difference beam 701 can also be produced by setting one half of the element phase shifters 180° out of phase relative to the other half. This applies to the case where the maximum excitations are located at adjacent pairs of elements. The graph of FIG. 7 shows a typical difference beam obtained experimentally.

Thus there has been described a new and improved amplitude distributed scanning switch employing an 8 element Butler or equivalent matrix. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An amplitude distributed scanning switch system usable with beam scanning and dual mode circular antenna arrays, comprising:

a matrix means having eight output terminals and eight input terminals, said matrix producing outputs at each output terminal of equal amplitude with varying progressive phase modes when any of its inputs is excited, the input terminals including $m=0$, and $m=+1$, and $m=-1$ mode input terminals, each of said input terminals except the $m=0$, $m=+1$, and $m=-1$ being coupled to load impedances;

a first variable phase shifter;

a second variable phase shifter;

a one input-three output power distribution network having a first output coupled to said $m=0$ input terminal, a second output coupled directly to the input of said first phase shifter, and a third output coupled directly to the input said second phase shifter;

the output of said first phase shifter being coupled directly the $m=-1$ mode input terminal; and the output of said second phase shifter being coupled directly to the $m=+1$ mode input terminal.

2. An amplitude distributed scanning switch system as recited in claim 1 wherein said one input-three output power distribution network includes:

a first 180 degree hybrid having its sum input coupled to receive a transmitter signal and its difference input coupled to a load impedance and providing two outputs;

a fixed phase shifter coupled to receive one of the outputs of said first hybrid;

a second 180 degree hybrid having its sum input coupled to receive one output of said first hybrid and having its difference input coupled to receive the output of said fixed phase shifter, one output of said second 180 degree hybrid being the first output of said power distribution network; and a third 180 degree hybrid having its sum input coupled to receive one output of said second 180 degree phase shifter and its difference input coupled to a load impedance, the outputs of said third 180 degree hybrid being the second and third outputs of said power distribution network.

3. An amplitude distributed scanning switch system as recited in claim 1 wherein said one input-three output power distribution network includes:

a one input-two output unequal power divider; and a 180 degree hybrid having its sum input coupled to one output of said unequal power divider and its difference input coupled to a load impedance.

4. The amplitude distributed scanning switch system according to claim 1, wherein said matrix means includes a Butler matrix.

* * * * *